US006997353B2

(12) United States Patent
Decottignies et al.

(10) Patent No.: US 6,997,353 B2
(45) Date of Patent: Feb. 14, 2006

(54) FLUID PRODUCT DISPENSER

(75) Inventors: Laurent Decottignies, Cergy (FR); Alain Behar, Suresnes (FR)

(73) Assignee: Airlesssystems, Charleval (FR)

( * ) Notice: Subject to any disclaimer, the term of this patent is extended or adjusted under 35 U.S.C. 154(b) by 0 days.

(21) Appl. No.: 10/396,484

(22) Filed: Mar. 26, 2003

(65) Prior Publication Data

US 2004/0188462 A1 Sep. 30, 2004

(51) Int. Cl.
*B65D 35/56* (2006.01)

(52) U.S. Cl. ..... 222/105; 222/212; 222/494

(58) Field of Classification Search ..... 222/95, 222/105, 212–213, 145.5, 491–494, 389, 222/525; 137/512.4
See application file for complete search history.

(56) References Cited

U.S. PATENT DOCUMENTS 3,200,995 A * 8/1965 Gangwisch ..... 222/94
3,225,967 A * 12/1965 Heimgartner ..... 222/183
4,098,434 A * 7/1978 Uhlig ..... 222/94
4,102,476 A * 7/1978 Loeffler ..... 222/209
4,159,790 A * 7/1979 Bailey ..... 222/211
4,585,149 A * 4/1986 Zulauf ..... 222/94
4,798,311 A * 1/1989 Workum ..... 222/131
4,953,753 A * 9/1990 Gortz ..... 222/105
5,098,428 A * 3/1992 Sandlin et al. ..... 606/22
5,273,191 A * 12/1993 Meshberg ..... 222/105
5,366,115 A * 11/1994 Kersten et al. ..... 222/105
5,803,311 A * 9/1998 Fuchs ..... 222/105
5,860,567 A * 1/1999 Fuchs et al. ..... 222/105
2003/0089735 A1 * 5/2003 Iwatsubo ..... 222/95

* cited by examiner

*Primary Examiner*—Frederick Nicolas
(74) *Attorney, Agent, or Firm*—Sughrue Mion, PLLC

(57) ABSTRACT

The invention concerns a fluid product dispenser comprising a gas reservoir (10), a fluid product reservoir (20), a dispensing head comprising at least one dispensing orifice (30). The gas reservoir and the fluid product reservoir are connected to the head so that their contents can communicate with the at least one dispensing orifice. The dispenser comprises a movable actuation wall (14; 24) to simultaneously generate a pressure state in the gas and fluid product reservoirs and thus force the fluid product and the gas through the the at least one dispensing orifice.

23 Claims, 10 Drawing Sheets

FLUID PRODUCT DISPENSER

TECHNICAL FIELD

This invention related to a fluid, liquid or powder product dispenser comprising a gas reservoir, a fluid product reservoir and a dispensing head comprising at least one dispensing orifice, gas and fluid product reservoirs being connected to the head so that their contents can communicate with the dispensing orifice. This type of dispenser can be used in the perfume, cosmetics and pharmaceutical fields.

BACKGROUND OF THE INVENTION

This type of fluid product dispenser distributes a mix of gas, usually air, and liquid or powder fluid product. Dispensing is therefore of the two-phase type in the form of an atomised jet in which fine droplets or grains are transported in an air stream. For example, document FR 2 748 407 describes a two-phase atomiser. The atomiser described in this document comprises a fluid product pump mounted on a fluid product reservoir. The pump comprises a pusher installed on the pump actuating stem. An air pump is formed inside the pusher around the actuating stem. This air pump is defined by a chamber inside which a piston slides in a leak tight manner. Furthermore, the pusher comprises a dispensing orifice that is supplied with a fluid product from the pump and air from the air chamber. Thus, there is an atomised two-phase dispensing at the exit of the dispensing orifice. Therefore, the atomiser or sprayer described in this document uses a pressurisable air reservoir and a fluid product reservoir with which a pump is associated to draw off the fluid product in the reservoir and to transport it to the dispensing orifice. The function of the pusher is to activate the pump and simultaneously pressurise the air contained in the air chamber. The effect of actuating the pusher is not to increase the pressure inside the fluid product reservoir, since the pump is inserted between the pusher and the fluid product reservoir.

SUMMARY OF THE INVENTION

The purpose of this invention is to define a two-phase dispenser with a simpler design than the design of the dispenser described according to prior art, in that it does not use a pump. Another purpose of this invention is to make a two-phase dispenser that is very simple to actuate.

In order to achieve these purposes, this invention relates to a dispenser with a movable actuation wall to simultaneously generate a pressure state in the gas and fluid product reservoirs and thus force the fluid product and the gas through the said at least one dispensing orifice. The actuation wall acts directly or indirectly on the two reservoirs to pressurise the contents in each reservoir. The movable actuation wall may for example act directly on the gas reservoir, and the pressure generated inside the gas reservoir is transmitted to the fluid product reservoir that is also pressurised. The reverse is also possible. The actuation wall can also act simultaneously and directly on the two reservoirs at the same time. According to one embodiment, the actuation wall forms a deformable wall element of the gas reservoir. Thus, the wall of the gas reservoir can be deformed or pushed in directly and the pressure generated inside the gas reservoir is transmitted to the fluid product reservoir.

According to another embodiment, the actuation wall forms an element of the deformable wall of the fluid product reservoir. Thus, the wall of the fluid product reservoir can be directly pushed in and the pressure generated is transmitted to the gas reservoir.

According to one advantageous characteristic of the invention, a pressure transmission wall forms a wall element of the gas reservoir and also a wall element of the fluid product reservoir. The transmission wall may be a wall common to the two reservoirs. For example, it could form part of the fluid or gas product reservoir. Advantageously, the pressure transmission wall can be deformed by the pressures applied in the reservoirs.

According to one embodiment, the fluid product reservoir is located inside the gas reservoir. Advantageously, the gas reservoir is provided with an inlet non-return valve that enables gas to penetrate into the gas reservoir. The gas reservoir may be directly actuated, for example by compressing or squeezing it by hand, which generates a pressure inside the gas reservoir which is transmitted to the fluid product reservoir located inside it. As a result, the gas and the fluid product are forced towards the dispensing head and then through the dispensing orifice. As soon as the pressure is released on the gas reservoir, gas, in this case air, can penetrate through the inlet non-return valve. The gas reservoir is then refilled with gas, while the fluid product reservoir may remain in its existing condition, in other words without inlet of any external air.

According to another embodiment, the gas reservoir is located inside the fluid product reservoir. Also in this case, the gas reservoir may be provided with an inlet non-return valve through which air, which is the gas used in this case, can penetrate into the gas reservoir. The fluid product reservoir may be directly actuated, for example by compressing or squeezing it by hand, to create a pressure inside the fluid product reservoir which is transmitted to the gas product reservoir located inside it. As a result, the gas and fluid product are discharged towards the dispensing head and then through the dispensing orifice. As soon as the pressure is released, gas, in this case air, can penetrate inside the gas reservoir through the inlet non-return valve.

According to a practical embodiment, the gas reservoir consists of a compressible or squeezable receptacle connected to the dispensing head. Furthermore, the fluid product reservoir may comprise a deformable flexible pouch.

According to another interesting characteristic of the invention, the dispensing head comprises a gas outlet non-return valve located between the gas reservoir and at least one of the said at least one dispensing orifice. Additionally, or as an alternative, the dispensing head comprises a fluid product outlet non-return valve between the fluid product reservoir and at least one of the said at least one dispensing orifice. Advantageously, the gas non-return valve opens and closes at a pressure below the pressure of the fluid product non-return valve. Thus, gas dispensing through the dispensing orifice starts before dispensing of the fluid product and ends after dispensing of the fluid product. Thus, this results in a perfect quality of the two-phase dispensing as a spray and a perfect cleanliness of the head at the dispensing orifice.

According to an embodiment, the dispenser may comprise at least two dispensing orifices, namely at least one gas dispensing orifice and at least one fluid product dispensing orifice. One or several dispensing orifices may distribute gas or fluid product only, while one or several other dispensing orifices may distribute a mix of gas and fluid product. Advantageously, the gas orifice surrounds the fluid product orifice. The fluid product orifice may be central and the gas orifice may be annular surrounding the fluid product orifice.

If a gas non-return valve and a fluid product non-return valve are provided, the gas non-return valve and the fluid product non-return valve each comprise a mobile member that will come into leak tight contact on a corresponding seat, the mobile members then advantageously being formed by a monobloc part. Preferably, the monobloc part forms two concentric sleeves comprising ends connected together and opposite ends forming two deformable flexible lips defining the mobile members.

According to another aspect of the invention, the dispenser may include closing means to prevent dispensing of the fluid product. Additionally, or as an alternative, the dispenser may also comprise closing means to prevent the dispensing of gas. Advantageously, the closing means may comprise a rotary device movable between an open and a closed position. Advantageously, the rotary device forms said at least one dispensing orifice. Advantageously, the rotary device forms an outlet non-return valve seat. Advantageously, the rotary device forms a visible external part of the dispensing head.

BRIEF DESCRIPTION OF THE DRAWINGS

The invention will now be described in more detail with reference to the attached drawings, giving several embodiments of the invention as non-limitative examples.

In the figures.

DETAILED DESCRIPTION OF THE PREFERRED EMBODIMENTS

In the various embodiments shown in the figures, the elements, parts, pieces, constituents, areas and locations with the same function or the same structure are always denoted by the same numeral references. Thus the gas reservoir is always denoted with numeral reference 10, the fluid product reservoir is always denoted by numeral reference 20, and the dispensing head by numeral reference 3.

In all embodiments, the dispensing head 3 distributes fluid product, which may be liquid or powder, and gas, which in this case is air, simultaneously; however, other gases or gas mixes can be used.

Figure 1:
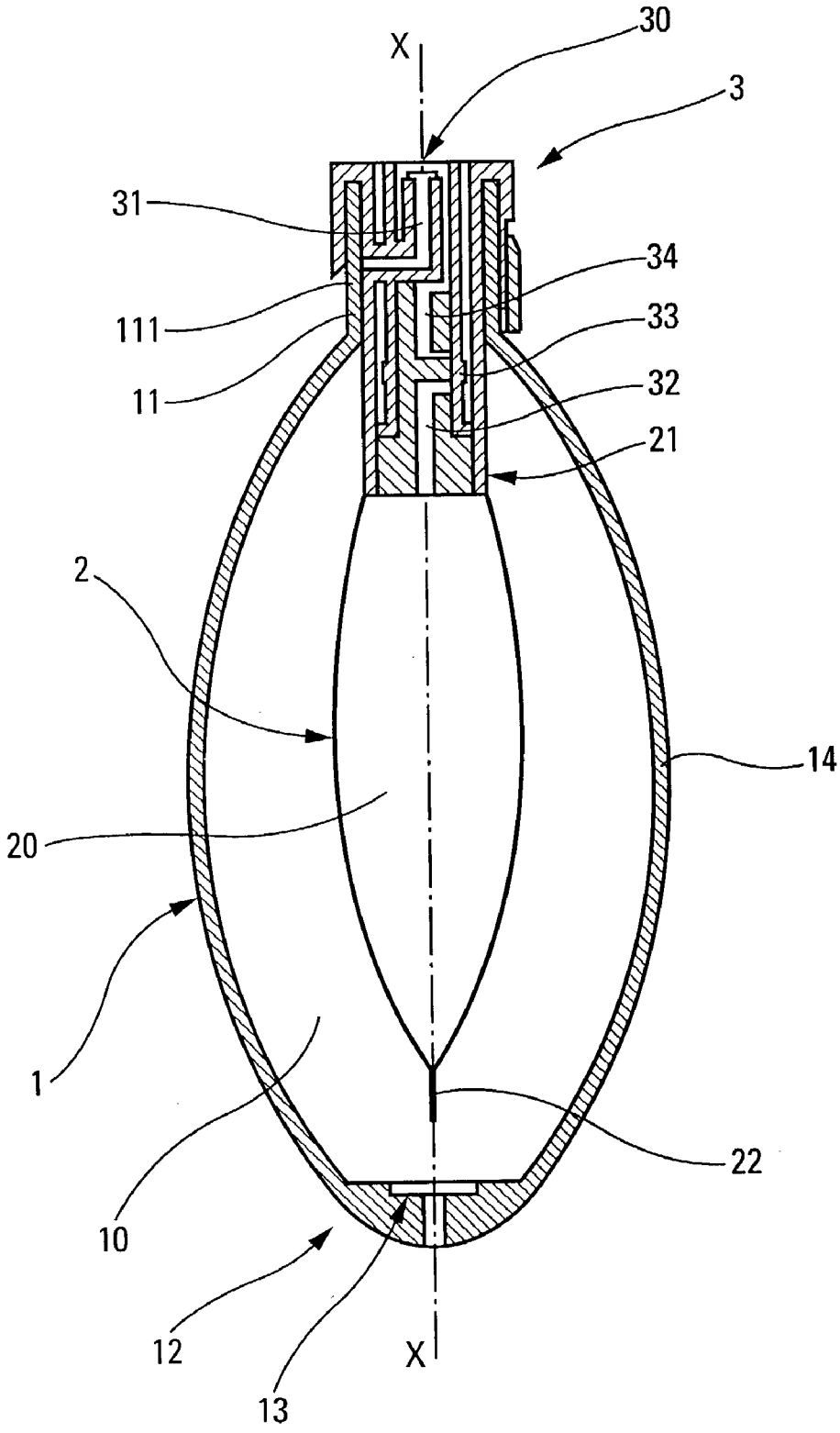
FIG. 1 is a vertical cross-sectional view through a fluid product dispenser according to a first embodiment of the invention.
Figure 7:
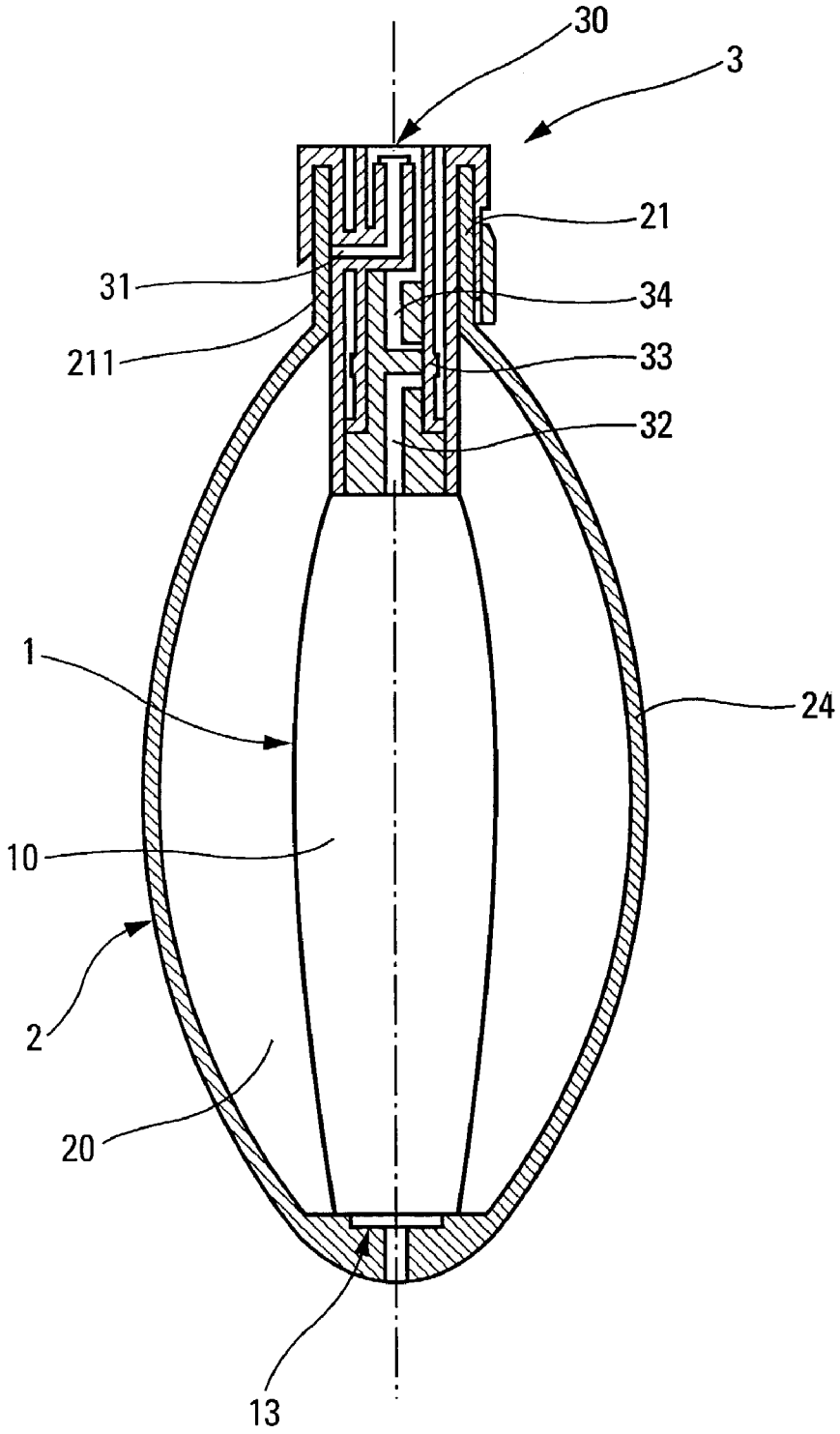
FIG. 7 is a vertical cross-sectional view through a dispenser according to a sixth embodiment of the invention.

In all embodiments, except for the embodiment shown in FIG. 7, the gas reservoir 10 is formed by an elastically deformable receptacle comprising a neck 11, a bottom 12 and a peripheral sidewall 14. The neck 11 may be made substantially rigid with at least one elastically deformable part 111. Its function will be given below. The sidewall 14 is at least partially and preferably entirely elastically deformable. For example, the sidewall 14 may be gripped and squeezed in one hand. The bottom 12 is preferably reinforced, but it can also be made in a similar manner or a comparable manner to the sidewall 14. The fluid product reservoir 20 may be made using a freely deformable flexible pouch 2 comprising an opening 21 fixed to the head 3 in a leak tight manner. The pouch 2 may for example be made using two freely deformable pieces of sheet welded around their peripheries and particularly at the bottom 22 as can be seen in FIG. 1. Thus, the elastically deformable receptacle and the flexible pouch are both connected to the dispensing head 3.

In all embodiments except for that shown in FIG. 7, the flexible pouch 3 is arranged inside the elastically deformable receptacle 1. Therefore, the flexible pouch 2 cannot be seen unless the receptacle 1 is made of a transparent material. The flexible pouch 2 contains the fluid product inside it and it is surrounded on the outside by the gaseous content of the gas reservoir 10. Thus, by pressing on receptacle 1, its gaseous content is pressurised and this pressure is transmitted to the content of pouch 2 through the pouch. Consequently, the wall of the flexible pouch 2 forms a pressure transmission wall between the gas reservoir 10 and the fluid product reservoir 20.

In all embodiments, including that shown in FIG. 7, the effect of pressurising the contents of the fluid product reservoir 20 and the gas reservoir 10 is to discharge part of their contents through the dispensing head 3 to one or several dispensing orifice(s) 30. Fluid product and gas are thus simultaneously forced out and are distributed simultaneously through a single dispensing orifice or through several common or separate dispensing orifices. The result is a two-phase spray jet at the outlet from the dispensing orifice(s) composed of gas and fluid product. The fluid product dispersed in fine droplets or grains is transported, channelled or guided by the pressurised gas stream.

In most embodiments, and particularly the embodiments in FIGS. 1, 2, 3, 8, 9 and 10, a gas outlet non-return valve is provided at the dispensing head 3 between the gas reservoir 10 and the dispensing orifice(s) 30. The function of this outlet non-return valve is to open and close at an approximately constant pressure called Pg. Thus, by pressing on the wall 14 of the deformable receptacle 1, the pressure will rise in the reservoir 10 and be transmitted to the reservoir 20 through the pouch 2. As soon as the pressure inside the reservoir 10 reaches the pressure Pg, the gas outlet non-return valve opens and gas can flow through the dispensing head 3 to the dispensing orifice or orifices. A detail of the structure of the outlet non-return valve will be given below with reference to the attached figures.

In most embodiments, and particularly the embodiments in FIGS. 1, 2, 3, 6, 6*a*, 8, 9 and 10, a fluid product outlet non-return valve is provided at the dispensing head 3 between the fluid product reservoir 20 and the dispensing orifice(s) 30. The function of this fluid product outlet non-return valve is to open and close as soon as the pressure inside the reservoir 20 reaches a determined pressure called Pf. Thus, by compressing the deformable receptacle 1, the pressure will rise in the gas reservoir 10 and this pressure will be transmitted to the fluid product reservoir 20 through the flexible pouch 2. As soon as the pressure inside the fluid product reservoir 20 reaches the pressure Pf, the outlet non-return valve opens and fluid product is then discharged through the dispensing head 3 and is distributed to the dispensing orifice(s) 30.

The two-phase dispenser according to the invention may incorporate a gas outlet non-return valve and a fluid product outlet non-return valve. In this case, it is advantageous but not necessary for the pressure Pg to be less than the pressure Pf. Thus, the gas outlet non-return valve will open before the fluid product outlet non-return valve opens. Symmetrically, the gas outlet non-return valve will close after the fluid product outlet non-return valve closes. This assures that gas will be distributed before the fluid product dispensing begins. Symmetrically, this assures that gas will be distributed after the fluid product dispensing is complete. This firstly assures good quality of the two-phase dispensing at the beginning of the dispensing, and secondly that the head is perfectly clean at the orifice(s) because all the fluid product is distributed by the gas dispensing which continues for a short time.

In some cases, the two-phase dispenser according to the invention may incorporate a single outlet non-return valve, in other words a gas outlet non-return valve or a fluid product outlet non-return valve. As an alternative embodiment, the two-phase dispenser according to the invention may not have any outlet non-return valves, either for gas or fluid product.

In all embodiments shown in the figures, including in FIG. 7, the gas reservoir is provided with an inlet non-return valve 13 that may for example be provided at the bottom 12. Other locations for the inlet non-return valve 13 are also possible. The function of the inlet non-return valve 13 is to allow external gas to enter inside the gas reservoir 10. Gas enters when the gas reservoir 10 is at a negative pressure compared with the outside. This gas inlet compensates for the gas outlet through the dispensing head 3. This is possible due to the elastic deformation characteristic of the receptacle 1. This receptacle always tends to return to its original shape, which creates a negative pressure inside the reservoir 10. As soon as the pressure in the reservoir 10 is approximately equal to the outside pressure, the inlet non-return valve 13 closes. The contents of the reservoir 10 are thus continuously renewed after each outlet through the head 3. This is not the case for the fluid product reservoir 20 which is stored inside the pouch 2 that is freely deformable. Consequently, the pouch 2 does not have a shape memory and consequently does not tend to return to its original shape. Therefore, there is no need for an inlet non-return valve for the fluid product reservoir 20. However, it would be possible to imagine a two-phase dispenser according to the invention in which the gas reservoir is not provided with an inlet non-return valve 13. For example, it would be possible to have single dose or two-dose type dispensers that can be actuated not more than once or twice. It would also be possible to imagine that the receptacle 1 could not be elastically deformed, such that it does not have any shape memory. The inlet non-return valve 13 for the reservoir 10 is particularly appropriate when the two-phase dispenser enables a large number of actuations and the receptacle 1 has a characteristic of elastic deformation with a shape memory.

We will now refer to the various figures illustrating different embodiments of this invention.

Figure 2:
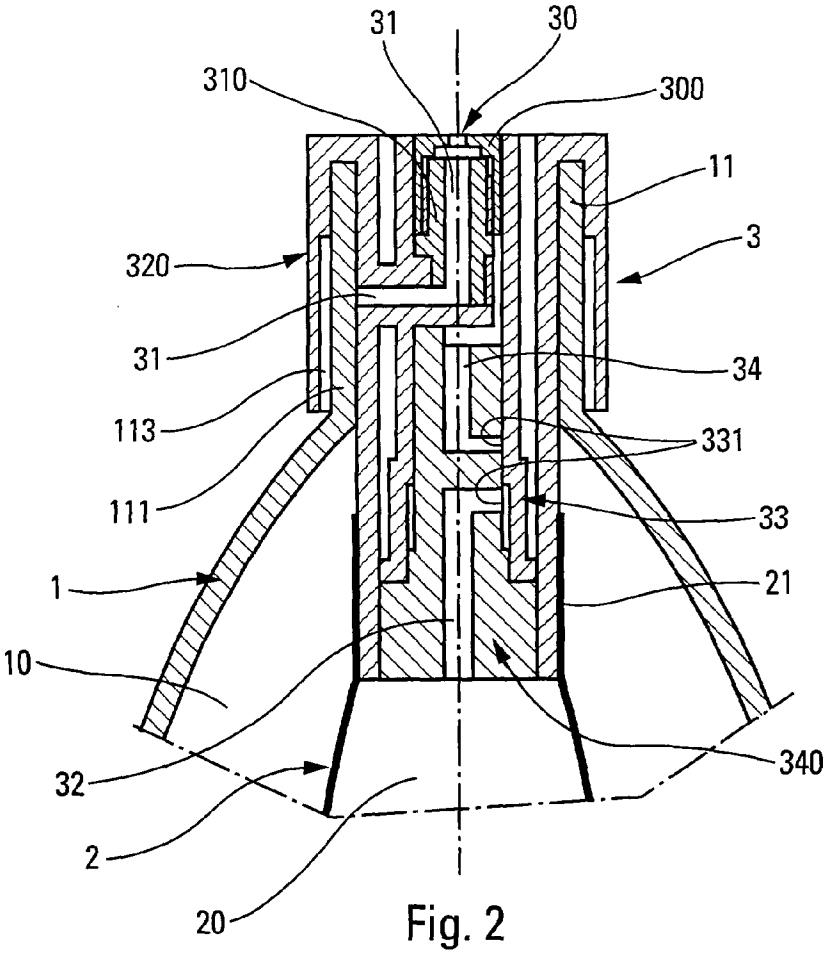
FIG. 2 is an enlargement of the upper part of the dispenser in FIG. 1.

FIGS. 1 and 2 show a two-phase dispenser according to a first embodiment of the invention. The gas reservoir 10 is formed by an elastically deformable receptacle 1 comprising a bottom 12 provided with an inlet non-return valve 13, a deformable wall 14 and a neck 11 in contact with the dispensing head 3. The fluid product reservoir 20 is formed by a freely deformable pouch 2 comprising an opening 21 fixed in a leak tight manner on the dispensing head 3. The fluid product reservoir 20 is arranged inside the gas reservoir 10. Thus, by compressing the deformable wall 14, the contents of the gas reservoir and the fluid product reservoir are pressurised. The inlet non-return valve 13 is then well closed.

We will now more particularly describe the dispensing head 3 with reference to FIG. 2. The head 3 comprises an attachment ring 320 in contact with the neck 11 of the receptacle 1. This ring 320 extends outside the neck 11 and also inside the neck 11. This ring 320 forms a gas outlet channel 31. This channel 31 is blocked on the upstream side by an elastically deformable part 111 formed by the neck 11. This part 111 will act as a mobile gas outlet non-return valve member in association with the entry of the channel 31. In other words, the elastically deformable part 111 is forced elastically into contact with the opening of the channel 31. However, this part 111 can separate from the opening of the channel 31 when the pressure inside the reservoir 10 reaches and exceeds pressure Pg. It can be seen that a free space 113 is formed between the ring 320 and the neck 11 at the deformable part 111. An insert 310 is placed in the ring 320 extending the gas outlet channel 31. The insert 310 is covered by a nozzle 300 fixed around the insert 310 inside the ring 320. This nozzle 300 forms a dispensing orifice 30. The gas channel outlet opens up at the nozzle 300 that advantageously forms an outlet chamber between the channel outlet 31 and the dispensing orifice 30. As can be seen in FIG. 2, the gas outlet channel 31, the insert 310 and the nozzle 300 occupy the top part of the dispensing head 3. The bottom part of the dispensing head 3 is also partially formed by the attachment ring 320. More precisely, the outside wall of the attachment ring 320 acts as an attachment surface for the opening 21 of the flexible pouch 2. On the inside, the ring contains an elastically deformable sleeve 33 and a spindle 340. The spindle 340 forms an outlet duct for the fluid product 32 that communicates with the inside of the fluid product reservoir 20 on the upstream side and with the sleeve 33 that acts as a mobile outlet non-return valve member for the fluid product, on the downstream side. The sleeve 33 closes the outlet from the duct 32 by being forced into contact with the outlet from the duct 32 in a leak tight manner. When the pressure inside the reservoir 20 reaches and exceeds a determined pressure Pf, the sleeve 33 is elastically deformed outwards and thus releases an outlet passage through which the pressurised fluid product inside the outlet duct 32 can pass. The product can then flow in an outlet channel 34, also formed by the spindle 340. The inlet to the outlet channel 34 is also closed off by the sleeve 33 at its internal wall 331. The outlet channel 34 is then prolonged inside the ring 320 to reach the nozzle 300. A flow passage is formed between the insert 310 and the nozzle 300. The pressurised fluid product can thus flow to the outlet chamber which advantageously forms a swirl chamber centred on the dispensing orifice 30.

Consequently, the dispensing head 3 in the embodiment shown in FIGS. 1 and 2 includes a gas outlet non-return valve for which the mobile member is formed by the deformable part 111 and a fluid product outlet non-return valve for which the mobile member is formed by the sleeve 33. As already mentioned, the pressure Pg at which the gas outlet non-return valve opens is less than the pressure Pf at which the fluid product outlet non-return valve opens. Thus, gas will reach the dispensing orifice 30 before the fluid product.

Figure 3:
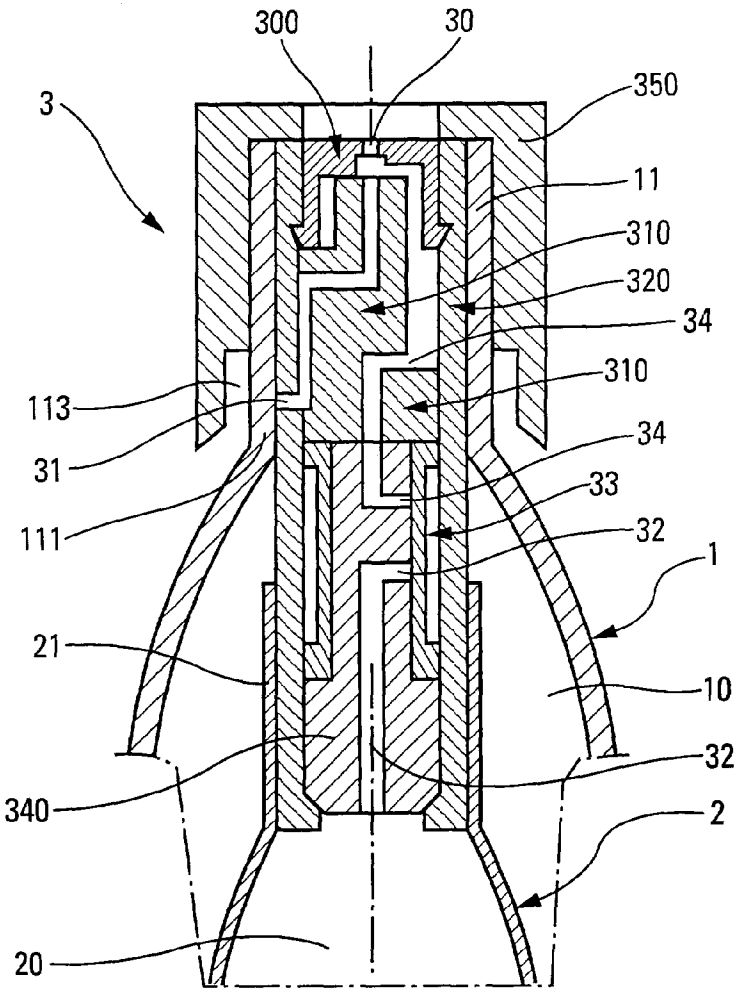
FIG. 3 is a view similar to the view in FIG. 2 for a variant of the dispenser according to the invention.

We will now refer to FIG. 3 that shows an alternative embodiment of FIGS. 1 and 2. The dispensing head 3 in FIG. 3 is very similar to that in FIG. 2. The head still comprises a ring 320 fixed inside the neck 11 that comprises a deformable part 111 acting as a mobile member of the gas outlet non-return valve. The bottom part of the ring 320 acts as the leak tight attachment of the opening of the flexible pouch 2. The ring 320 holds an insert 310 forming the outlet channel 31 for which the inlet is closed off by the outlet non-return valve and for which the outlet communicates through a swirl chamber centred on the dispensing orifice 30. The orifice is also formed by a nozzle 300 forced onto the insert 310 inside the ring 320. The nozzle 300 in combination with the insert 310 forms one or several swirl channels that communicate tangentially with the swirl chamber. A lateral passage is also formed for the inlet of the fluid product. The insert 310 and the ring 320 form the outlet channel 34 separated from the outlet duct 32 by the fluid product outlet non-return valve by the sleeve 33. The opening pressure Pg of the gas non-return valve formed may advantageously be less than the opening pressure Pf of the fluid product non-return valve. The gas reservoir may be provided with an inlet non-return valve. The head 3 in FIG. 3 is different from the head in FIGS. 1 and 2 by the fact that the ring 320 in this case is made of two parts; the outside part surrounding the neck 11 in this case is formed by a shell 350 in contact with the neck 11 and blocking the ring 320 inside the neck 11. A free space 113 is also formed at the deformable part 111 that acts as a gas outlet non-return valve mobile member.

Figure 4:
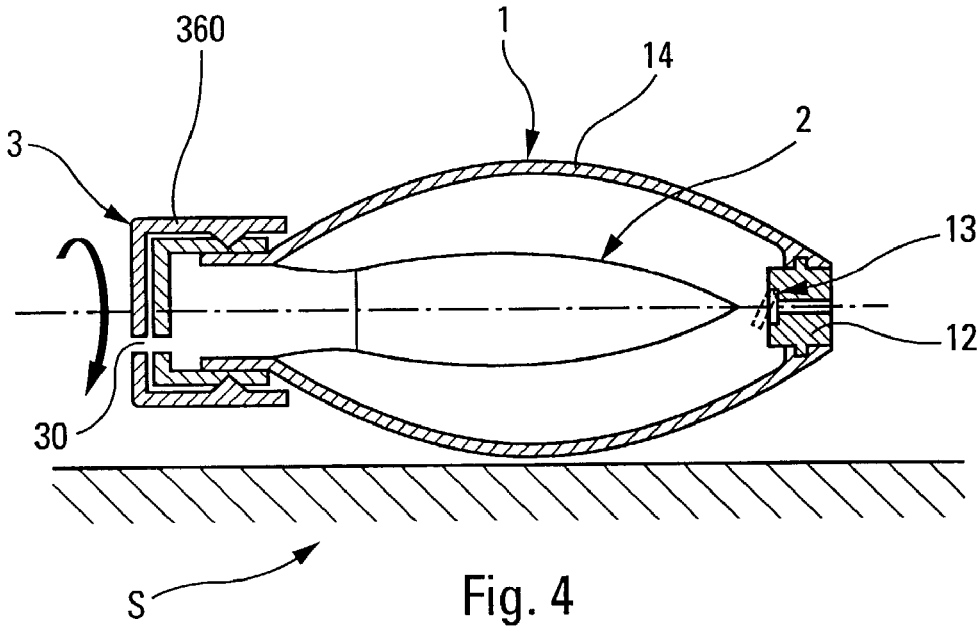
FIG. 4 is a vertical cross-sectional view through a dispenser according to a second embodiment of the invention.

FIG. 4 shows an embodiment in which the two-phase dispenser according to the invention is particularly suitable for placement in a horizontal manner, in other words with a substantially plane surface with its sidewall 14. The deformable receptacle bottom forming the gas reservoir may be provided with an inlet non-return valve 13 and the flexible pouch 2 forming the fluid product reservoir is located inside the receptacle 1. The internal structure of the dispensing head 3 is not shown. However, in this case the head 3 is provided with a rotary cover 360 that selectively closes the dispensing orifice(s) to enable dispensing or prevent unwanted dispensing. Therefore, this rotary cover 360 acts as closing means acting both on the gas dispensing and the fluid product.

Figure 5:
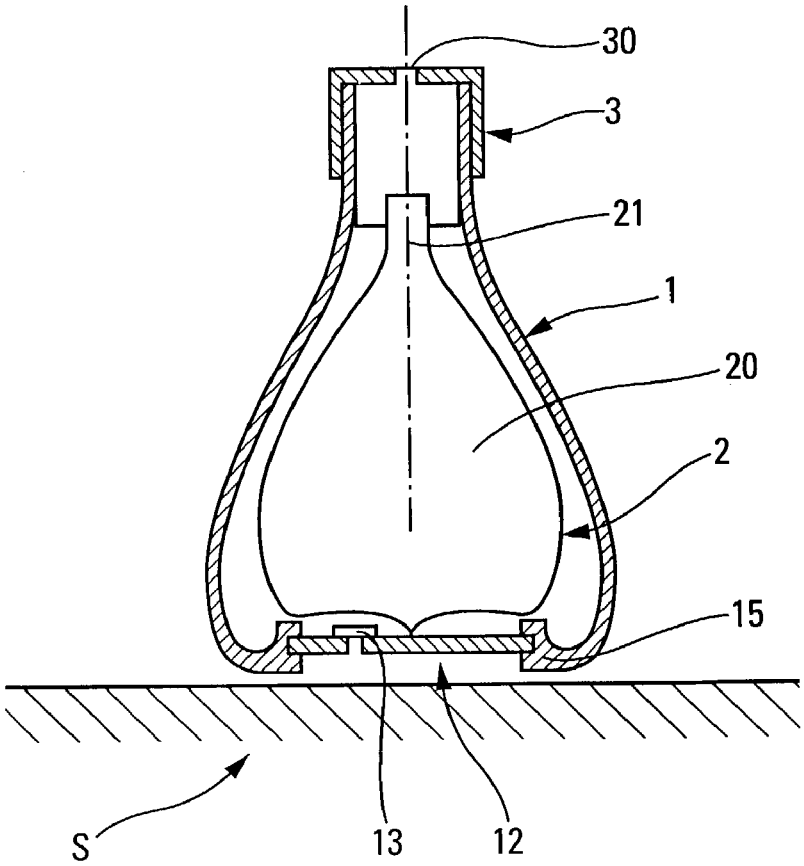
FIG. 5 is a view similar to FIG. 4 for a third embodiment according to the invention.

In FIG. 5, the two-phase dispenser according to the invention is particularly suitable for being arranged vertically. To achieve this, the deformable receptacle 1 is provided with an added bottom 12 supporting the inlet non-return valve 13. The bottom 12 is surrounded by a support ring 15 that defines the support surface of the dispenser on a substantially plane surface S. In the embodiment shown in FIGS. 6*a* and 6*b*, the dispensing head 3 does not have a gas outlet non-return valve. The gas outlet channel 31 communicates directly with the gas reservoir 10. Another special feature of this embodiment is the fact that the gas outlet channel 31 opens up at an annular gas dispensing orifice. The fluid product is discharged outside the reservoir 20 through the duct 32, deforms the sleeve 33 that acts as a non-return valve, then flows into the outlet channel 34 to the central dispensing orifice that is surrounded by the gas dispensing orifice. The central orifice and the annular orifice together form the fluid product dispensing orifice 30.

Figure 6A:
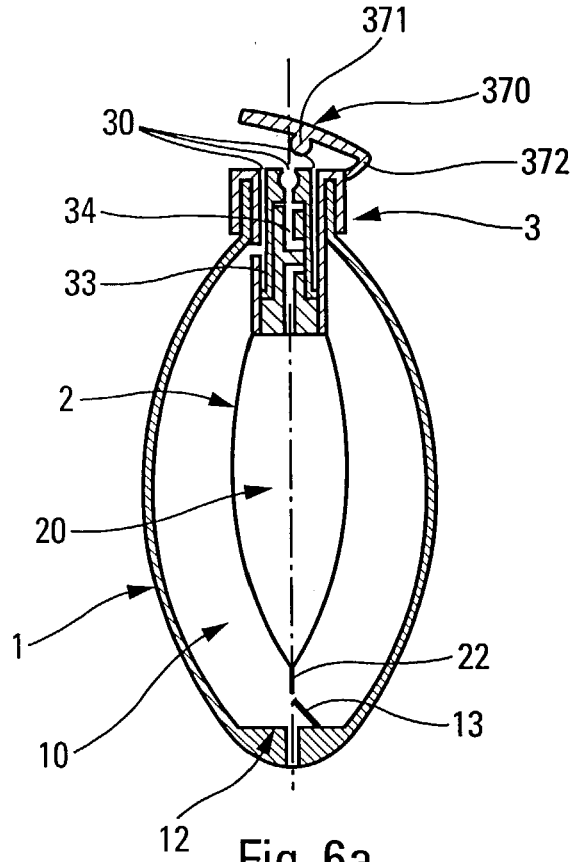
FIG. 6*a* is a vertical cross-sectional view through a dispenser according to a fourth embodiment of the invention.
Figure 6B:
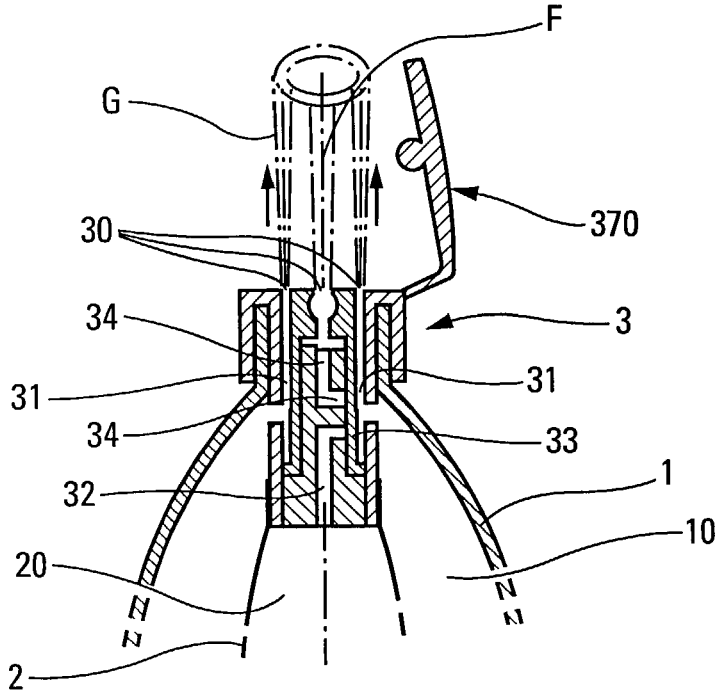
FIG. 6*b* is a view of the upper part of the dispenser according to a fifth embodiment of the invention.

FIG. 6*b* shows the dispensing diagram at the outlet from orifice 30. It can be seen that the gas G forms a cylinder inside which the fluid product F is sprayed. Thus, the fluid product is surrounded by a cylinder of pressurised gas. According to another characteristic of this embodiment, the dispensing head 3 comprises a closing cover 370 comprising a closing pin 371 that is housed in the fluid product dispensing orifice. Inserting the pin 371 into the orifice keeps the cover 370 in contact with the gas outlet orifice. Thus, the cover 370 acts as a closing means preventing gas and fluid product dispensing.

The embodiment shown in FIG. 7 is different from other embodiments by the fact that the gas reservoir 10 is located inside the fluid product reservoir 20. This embodiment is almost an inversion of the fluid product and gas reservoirs. The fluid product reservoir 20 may be formed by an elastically deformable receptacle 2 with a structure and even a shape similar or very similar to the shape of the gas receptacle 1 in previous embodiments. The gas reservoir 10 may be formed from a freely deformable flexible pouch 1 located inside the receptacle 2 and provided with an inlet non-return valve 13. The inlet non-return valve 13 may for example be formed at the bottom of the receptacle 2 which is common to the pouch 1. In this case, direct pressure is applied on the fluid product receptacle 2 by hand, which has the effect of generating a pressure inside the reservoir 20 that is transmitted to the contents of the gas reservoir 10 through the flexible pouch 1. The flow of gas and fluid product may take place through a dispensing head 3 that may be identical to the dispensing head in FIGS. 1 and 2. The elastically deformable receptacle 2 comprises a neck 21 in contact with the dispensing head 3. The neck 21 comprises an elastically deformable part 211 that acts as the mobile part of the a fluid product outlet non-return valve in leak tight selective contact on the opening of the fluid product outlet non-return valve 31 that opens up at the dispensing orifice 30. This embodiment shows that the arrangement of gas and fluid product reservoirs is not limited to the arrangements in previous embodiments, and that the fluid product can act as a pressure transmission medium to apply pressure to the contents of the gas reservoir located inside it.

It would also be possible to imagine embodiments in which the compression force exerted by the user's hand is directly applied to the contents of the fluid product reservoir and to the contents of the gas reservoir. In other words, one of the two reservoirs is not necessarily located inside the other reservoir. For example, it would be possible to imagine a receptacle in which part of the outside wall partially forms the fluid product reservoir and the other part partially forms the gas reservoir. The principle of this invention depends solely on the fact that a two-phase dispensing of the fluid product and gas is done by pressing on an actuation wall that advantageously forms an element of the deformable wall of the gas reservoir, the fluid product reservoir or both reservoirs.

Figure 8:
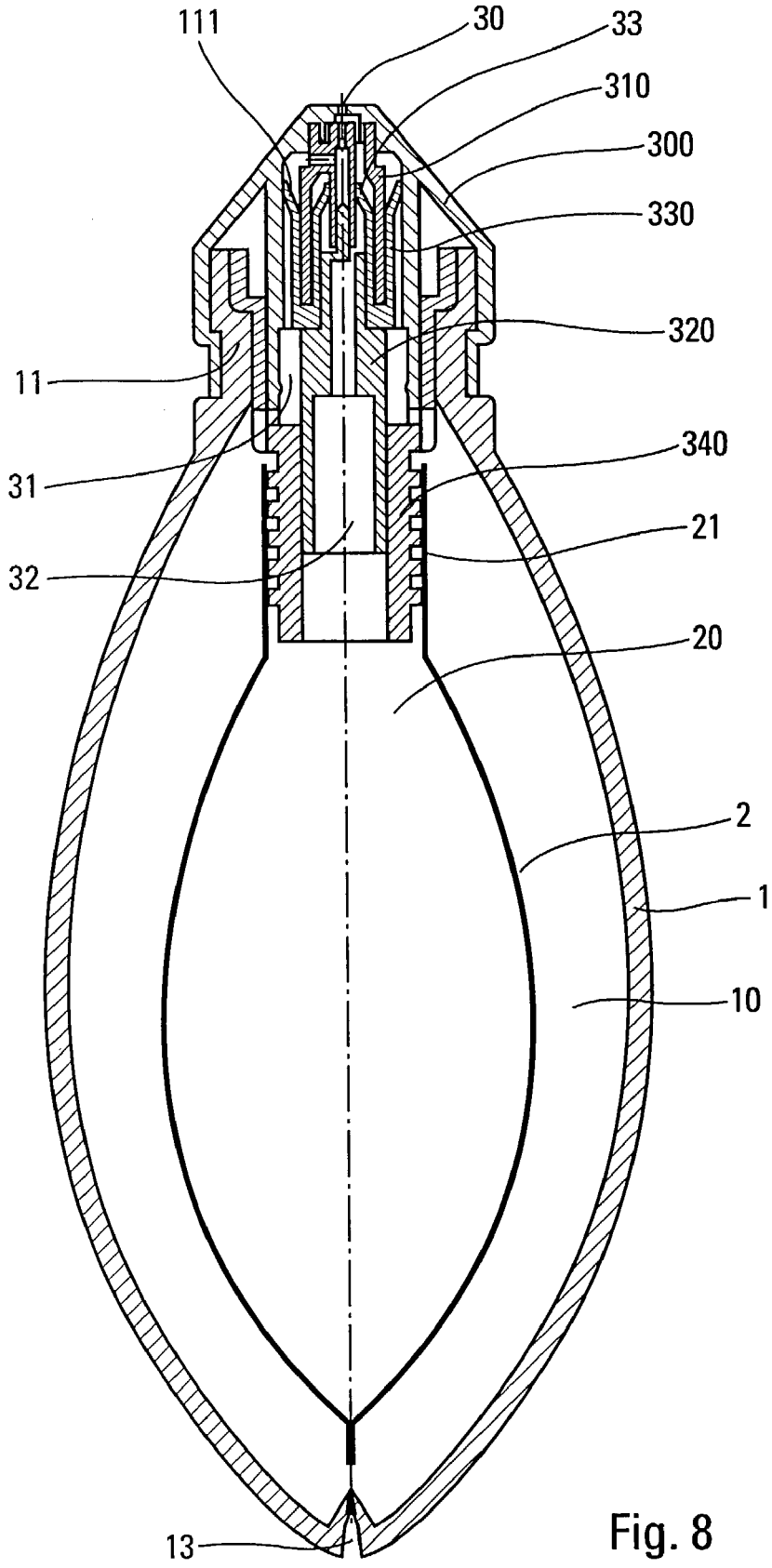
FIG. 8 is a vertical cross-sectional view through a dispenser according to a seventh embodiment of the invention.
Figure 9:
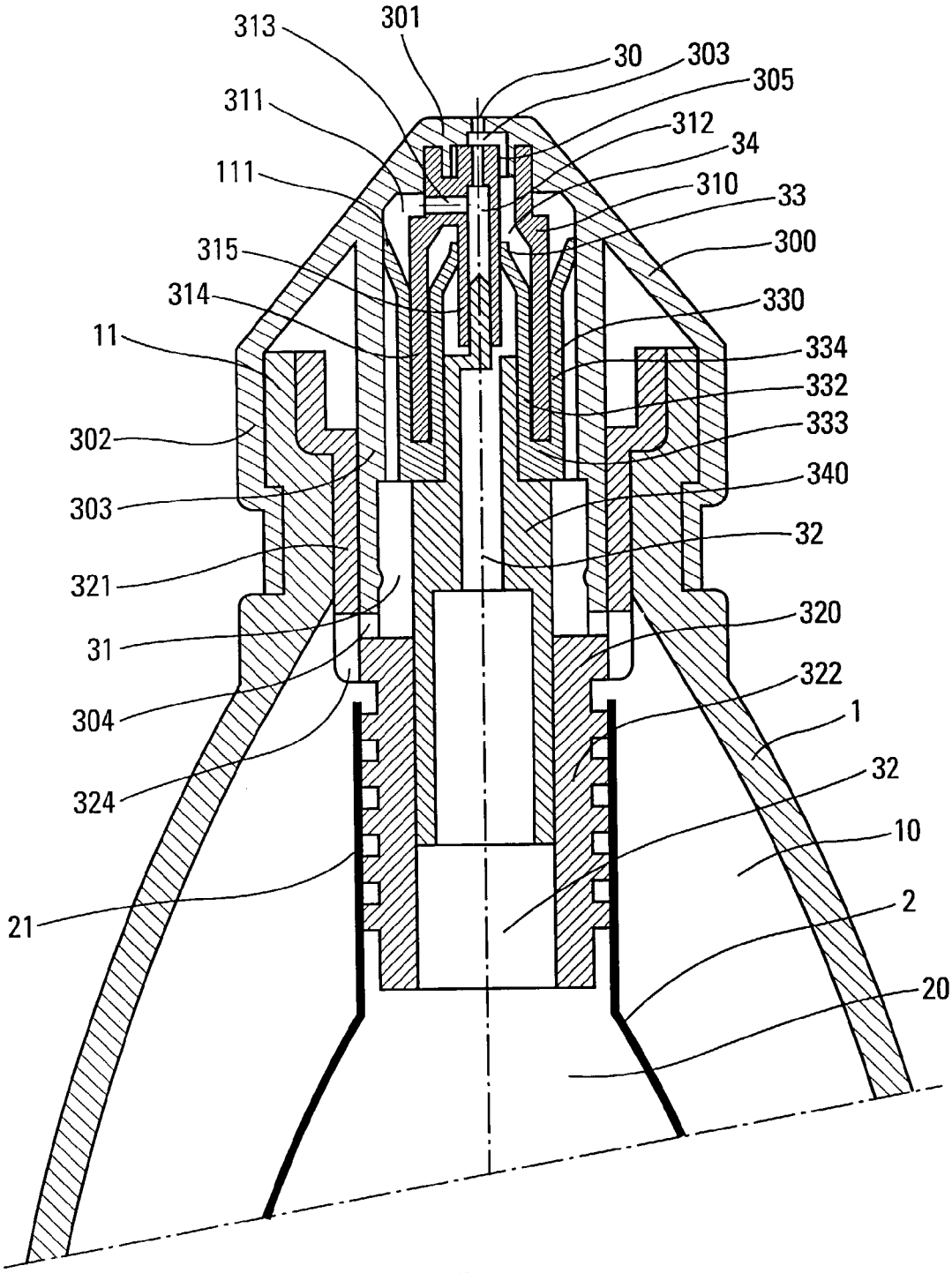
FIGS. 9 and 10 are enlarged views of the upper part of the dispenser in FIG. 8, in the open and closed positions respectively.
Figure 10:
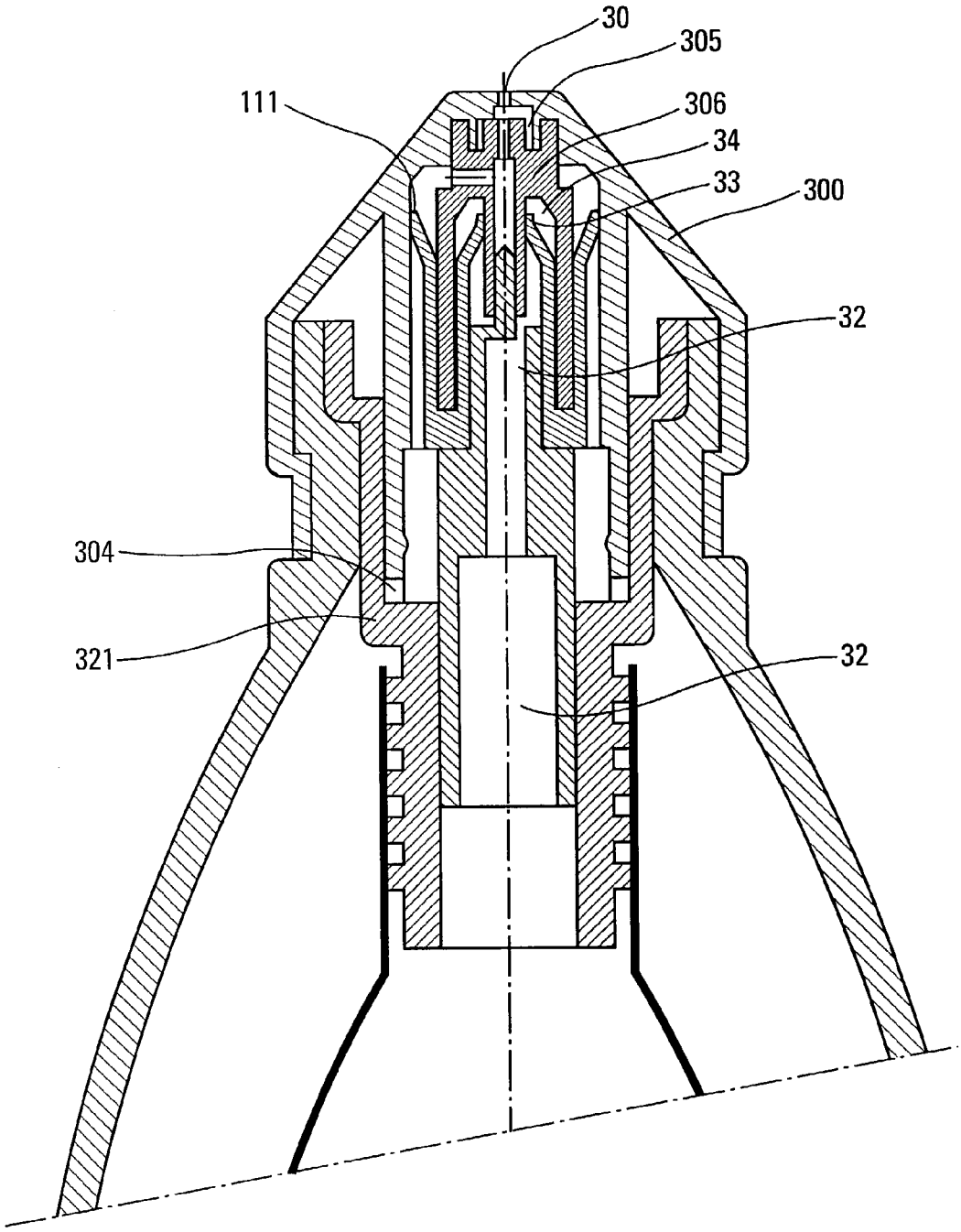

We will now refer to FIGS. 8, 9 and 10 to explain another embodiment of the invention. The two-phase dispenser in this embodiment comprises a general structure similar to the structure in FIGS. 1 and 2, namely with an elastically deformable receptacle 1 forming a gas reservoir 10 containing a freely deformable flexible pouch 2 forming a fluid product reservoir 20. The two reservoirs communicate with a dispensing head 3 that we will describe in detail. The receptacle 1 may be provided with an inlet non-return valve 13.

With reference to FIGS. 9 and 10, it can be seen that the dispensing head 3 comprises an attachment ring 320 fixed inside the neck 11 and advantageously fixed in place by radial clamping. The ring 320 comprises an attachment bushing 321 in direct contact with the neck 11 and a neck sleeve 322 on which the opening 21 of the pouch is advantageously fixed by welding. At the location at which the sleeve 322 is connected with the bushing 321, the bushing 321 forms one or several crossing window(s) 324 that goes) through the thickness of the bushing 321 to create communication between the outside and the inside of the ring 320. A spindle 340 fits inside the ring 320, forming an inlet duct 32 inside it. A lower part of the inlet duct 32 may also be formed by the sleeve 322 of the ring 320. The spindle 340 is force fitted into the sleeve 322 such that an annular part is formed in the bushing 321 around the spindle 340. The windows 324 provide communication between the outside of the ring and this annular part. The upper part of the spindle 340 is used to support a single-piece part 330. This part 330 comprises an inner sleeve 332 and an outer sleeve 334 arranged approximately concentrically. The two sleeves are connected at their lower ends by a cylindrical rim 333 that is in contact on the spindle 340. At their opposite ends, the sleeves form annular elastically deformable lips. The lip of the inner sleeve 332 is denoted by the numeral reference 33, and the lip of the outer sleeve 334 is denoted by the numeral reference 111. The outer lip 111 is inclined and faces outwards, while the inside lip 33 is inclined and faces inwards. The two sleeves are arranged concentrically, consequently a housing is formed between the two sleeves. An insert 310 is placed inside this housing. This insert 310 comprises a tubing 315 in contact with the spindle 340. The inside lip 33 comes into leak tight elastic contact on the outside of the tubing 315. The inside of this tubing 315 forms a section of the outlet channel 312. The insert 310 also forms an outlet channel for the fluid product 34. The insert 310 is in contact with the monobloc part 33 through a cylinder 314 force fitted between the two sleeves 332 and 334. The insert 310 also forms a section of the side outlet channel 313. This section 313 opens up onto the channel section 312 that opens up on the downstream side towards the dispensing orifice 30.

The dispensing head also comprises a rotary element 300 that defines the dispensing orifice 30 at a head wall 301. The rotary element 300 also comprises a rotary attachment collar 302 in contact with the outside of the neck 11. The rotary element 300 also comprises an inside cylindrical wall 303 that extends to the inside of the bushing 321 of the ring 320. The lower edge of the cylindrical wall 303 is formed with one or several recesses or notches 304 that are arranged at the same height as the passage windows 324. This can be clearly seen in FIG. 9. Furthermore, the head wall 301 of the rotary element 300 comes into contact with the insert 310 to form a swirl chamber 303 between them located between the outlet of the channel section 312 and the dispensing orifice 30. The head wall 301 and the insert 310 may also form swirl channels between them supplied by one or more supply passages 305. The outlet channel 34 communicates directly with this passage 305. The outside lip 111 is in leak tight contact with the inside of the cylindrical wall 303. The gas outlet channel 31 is formed between the cylindrical wall 303 and the spindle 340 and then between the cylindrical wall 303 and the outer sleeve 334. Since the lips 33 and 111 are elastically deformable and consequently flexible, one of them can deflect inwards and the other can deflect outwards so as to create a communication on each side. More precisely, when the inside lip 33 deflects outwards, a passage is created between the duct 32 and the channel 34. Similarly when the outside lip 111 deflects inwards, a communication is set up between the channel 31 and the section 311. Thus, fluid product outlet from the reservoir 20 can flow through the duct 32 beyond the lip 33 in channel 34 and then through the passage 305 to enter the chamber 303 from which it is expelled through the dispensing orifice 30. Symmetrically, gas outlet from the reservoir can pass through the windows 324, the notches 304 to enter the channel 31, and can pass around the deflected lip 11 to reach the section 311. From here, gas can escape through the side section 313 to the central section 312 to enter the chamber 303 and consequently pass through the dispensing orifice 30.

Thus, the lips 33 and Ill act as a fluid product outlet non-return valve mobile member and a gas outlet non-return valve mobile member, respectively.

The rotary element 300 is installed free to rotate on the neck 11, and also free to rotate relative to the insert 310 and the ring 320. The rotary element may possibly drive the monobloc part 330 in rotation. However, it is preferable that the monobloc part is fixed relative to spindle 340, which is also fixed with respect to the ring 320, which is itself fixed with respect to the neck 11. Thus, the rotary element is the only rotative element and does not move any other dispenser element. In the position shown in FIG. 9, the passage windows 324 are aligned at the same angles as the notches 304 formed at the lower end of the cylindrical wall 303 of the rotary element 300. Consequently, gas from the reservoir 10 can enter inside the head through the windows 324 and notches 304. The gas can thus reach the channel 31. If the pressure is high enough, the gas in the channel 31 will make the lip 11 deflect inwards in order to open up a passage towards the dispensing orifice 30. Symmetrically, the fluid product from the reservoir 20 can penetrate into the head through the duct 32. If the pressure is high enough, the lip 33 will deflect outwards to release a passage towards the channel 34 to enable communication with the dispensing orifice 30 through the passage 305 and the chamber 303. By turning the rotary element 300, for example by gripping it at the collar 302, the position shown in FIG. 10 can be reached. For better clarity, the rotary element remains static between the position in FIG. 9 and the position in FIG. 10. The remainder of the dispenser had turned by a certain angle, for example 30° or 60°. In this position, it can be seen that there are no more windows 324 at the notches 304. Thus, the gas can no longer enter inside the head. Furthermore, the insert 310 forms a closing segment 306 that closes the inlet to the passage 305 at the channel 34. In this way there is no longer any communication between the fluid product reservoir and the dispensing orifice 30. Thus, with a simple rotation of the element 300, the gas inlet and the fluid product are cut off between the corresponding reservoirs and the dispensing orifice 30. Obviously, this invention is not limited to the location or the structural means necessary to achieve this double closure. Closing can be made at different locations, depending on the construction of the dispensing head. Obviously, this closing characteristic is entirely independent of the characteristic related to the mobile non-return valve members formed in an integral piece. This simple or double closing function may also be used in some previous embodiments. The same is true for the monobloc type construction of the part 330.

Figure 12:
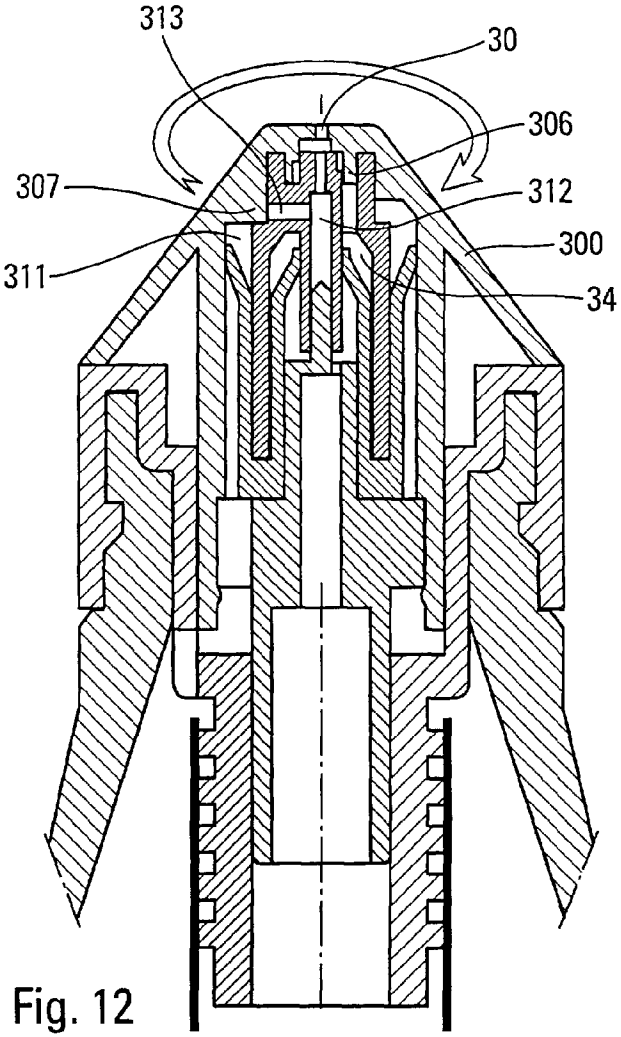
FIGS. 11 and 12 are sectional views of an alternative embodiment of FIGS. 9 and 10, and FIGS. 13 and 14 are sectional views of a sub-alternative embodiment of FIGS. 11 and 12.
Figure 11:
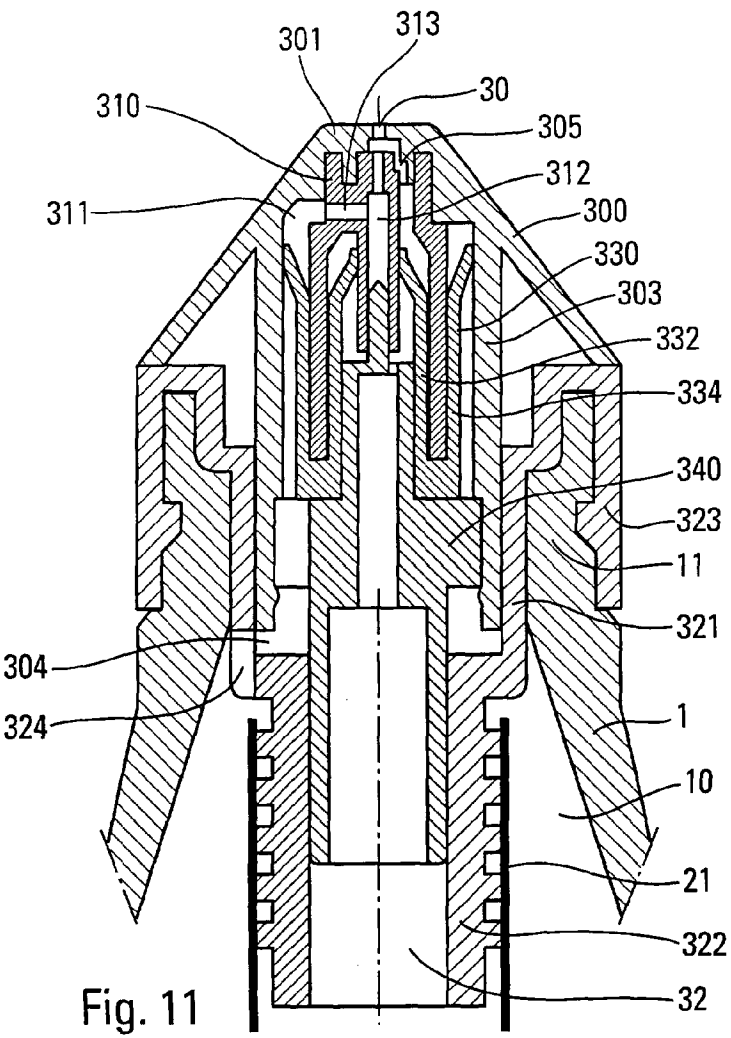

FIGS. 11 and 12 show the upper part of a fluid product dispenser in the open and closed positions respectively. The embodiment shown in FIGS. 11 and 12 form an alternative embodiment of the previous embodiment shown in FIGS. 8 to 10. The structure or architecture of the dispensing head is very similar and even almost identical in some parts. The monobloc part 330 that forms the two sleeves 332 and 334 may be identical to the embodiment in FIGS. 8 to 10. The same is true for the spindle 340. The ring 320 also forms a sleeve 322 around which the opening 21 of the flexible pouch is welded. Above this sleeve 322, the ring forms a bushing 321 trapped inside the neck 11 of the receptacle 1. There is a difference with the previous embodiment in that the ring 320 forms a shell 323 that snap fits with the outside of the neck 11. The ring 323 can be compared with the collar 302 in the previous embodiment. However, the shell 323 is not designed to rotate around the neck 11. On the other hand, it is better if the ring 320 is installed fixed on the neck 11. As in the previous embodiment, the ring 320 also forms one or several passage windows 324 through which the gas or fluid product can pass. The insert 310 is almost identical to the insert in the previous embodiment shown in FIGS. 8 to 10. The only minor difference is in the shape of the closing segment 306 that selectively cuts off the passage between the channel 34 and the dispensing orifice after the rotary element 300 has turned. Furthermore, the rotary element 300 is similar to the rotary element in the previous embodiment, except that it does not form a rotary collar 302 as mentioned above. Furthermore, the lower end of the cylindrical wall 303 is not formed with notches, but stops away from the sleeve 322 such that the windows 324 still communicate with the inside of the ring through the space 304 that remains between the lower end of the cylindrical wall 303 and the sleeve 322. This can be seen in FIGS. 11 and 12. Therefore, the closure of the passage for the fluid product or the gas from the space between the receptacle 1 and the pouch 2 is no longer cut off at the window 324. On the other hand, this communication is cut off by a closing pad 307 formed by the rotary element 300 as can be seen in FIG. 12. This closing pad 307 is positioned in front of the inlet to section 313 so as to cut off communication between section 311 and section 313. Thus, by turning the rotary element 300 with respect to the remaining part of the dispensing head, the gas and fluid product passages can be selectively opened and blocked off. The two passages are open in FIG. 11, while in FIG. 12 the two passages are closed after the element 300 has turned. Use of the head is similar to use of the head in the embodiment in FIGS. 8 to 10. Therefore, the only differences are in the location of the means for closing off the gas and fluid product passages, and accessorily in the attachment of the ring 320 on the neck 11.

Figure 14:
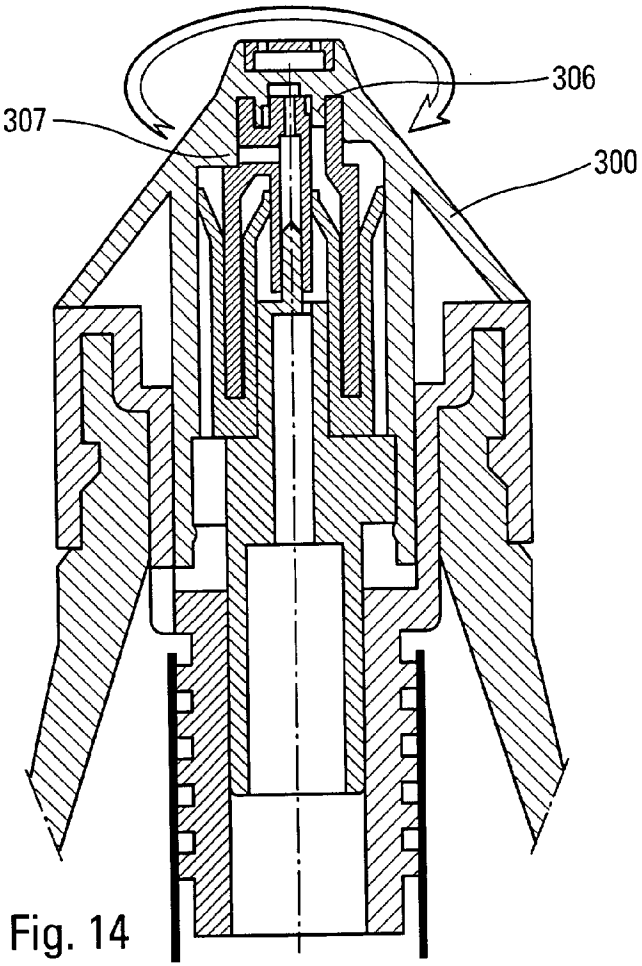
Figure 13:
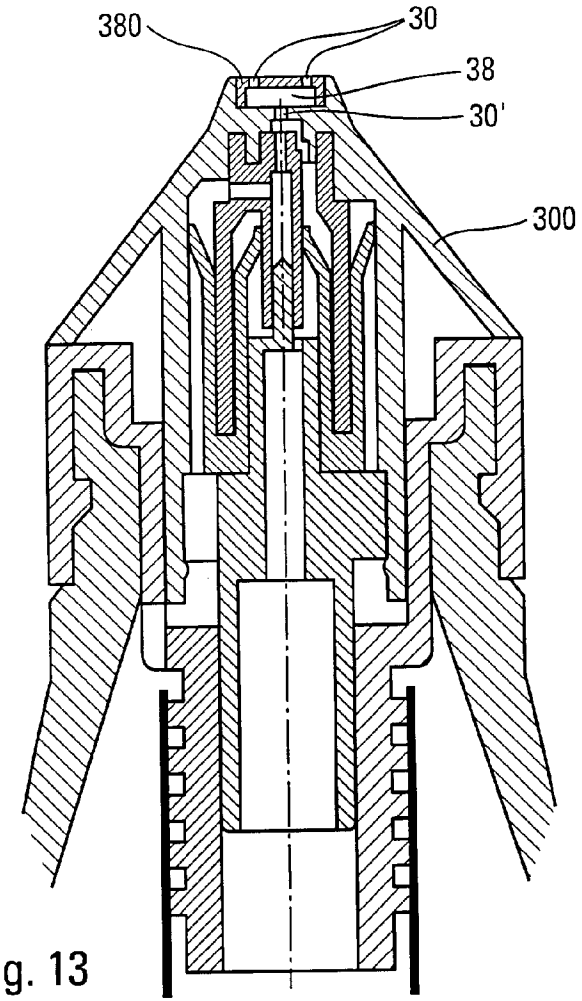

FIGS. 13 and 14 show a sub-alternative embodiment of the previous embodiment of FIGS. 11 and 12, which together form an alternative embodiment of the previous embodiment in FIGS. 8 to 10. The dispensing head is fully identical to that in the embodiment in FIGS. 11 and 12, except at the rotary element 300. The element 300 cooperates in the same way with all other elements from which the head is formed. However, the dispensing orifice 30 that in this case is in the form of several dispensing holes, is no longer formed directly by the rotary element 300, but by a dispensing plate 380 installed on the rotary element 30 so as to form a foam formation chamber 38 between them. This foam formation chamber 38 is located between a common gas and fluid product outlet 30' and the dispensing holes 30. The common outlet 30' may have the same architecture as the dispensing orifice 30 in previous embodiments. The mix of fluid product and gas that penetrates into the chamber 38 from the outlet 30' suddenly impiges the plate 380 which has the effect of creating turbulences that promotes the formation of a foam. The foam thus formed then escapes through the dispensing holes 30. The closing system for gas and fluid product passages is identical to the closing system for the embodiment in FIGS. 11 and 12, using a closing segment 306 and a closing pad 307.

Some characteristics described with reference to a precise embodiment may be used in other embodiments. A person skilled in the art should be capable of making these combinations of characteristics in different embodiments, unless there is a specific reason why it should not be possible.

The invention can be used to make a two-phase "squeeze bottle" type dispenser.

What is claimed is:

1. Fluid product dispenser comprising:

a gas reservoir (10), a fluid product reservoir (20), a dispensing head comprising at least one dispensing orifice (30), the gas reservoir and fluid product reservoir being connected to the head so that their contents can communicate with the said at least one dispensing orifice, and a movable actuation wall (14; 24) to simultaneously generate a pressure state in the gas and fluid product reservoirs and thus force the fluid product and the gas through the said at least one dispensing orifice;

wherein the dispensing head comprises a gas outlet non-return valve located between the gas reservoir and at least one of the said at least one dispensing orifice, the dispensing head comprising a fluid product outlet non-return valve located between the fluid product reservoir and at least one of the said at least one dispensing orifice, the gas outlet non-return valve opening and closing at a pressure Pg below a pressure Pf at which the fluid product non-return valve opens and closes.

2. Dispenser according to claim 1, in which the actuation wall (14) forms a deformable wall element of the gas reservoir (10).

3. Dispenser according to claim 1, in which the actuation wall (24) forms a deformable wall element of the fluid product reservoir (20).

4. Dispenser according to claim 1, in which a pressure transmission wall (2, 1) forms a wall element of the gas reservoir (10) and also a wall element of the fluid product reservoir (20).

5. Dispenser according to claim 4, in which the pressure transmission wall can be deformed by the pressures applied in the reservoirs.

6. Dispenser according to claim 1, in which the fluid product reservoir (20) is located inside the gas reservoir (10).

7. Dispenser according to claim 6, in which the gas reservoir (10) is provided with an inlet non-return valve (13) that enables gas to penetrate into the gas reservoir.

8. Dispenser according to claim 1, in which the gas reservoir (10) is located inside the fluid product reservoir (20).

9. Dispenser according to claim 1, in which the gas reservoir consists of a squeezable receptacle (1) connected to the dispensing head (3).

10. Dispenser according to claim 1, in which the fluid product reservoir comprises a deformable flexible pouch (2).

11. Dispenser according to claim 1, in which the dispensing head (3) comprises a gas outlet non-return valve (111) located between the gas reservoir (10) and at least one of the said at least one dispensing orifice (30).

12. Dispenser according to claim 1, in which the dispensing head (3) comprises a fluid product outlet non-return valve (33) located between the fluid product reservoir (20) and at least one of the said at least one dispensing orifice (30).

13. Dispenser according to claim 1, comprising at least two dispensing orifices (30), namely at least one gas dispensing orifice and at least one fluid product dispensing orifice.

14. Dispenser according to claim 13, in which the gas orifice surrounds the fluid product orifice.

15. Dispenser according to claim 1, in which the gas outlet non-return valve comprises a gas non-return valve mobile member (111) and a gas non-return valve seat, the fluid product non-return valve comprises a fluid product non-return valve mobile member (33) and a fluid product non-return valve seat, and the mobile members being formed by a monobloc part (330).

16. Dispenser according to claim 1, comprising closing means (360; 370; 305) to prevent dispensing of the fluid product.

17. Dispenser according to claim 1, comprising closing means (360, 370, 321) to prevent the dispensing of gas.

18. A fluid product dispenser according to claim 1, further comprising closing means (360; 370; 321; 305) to prevent the dispensing of fluid product and gas, the closing means comprising a rotary device (300) movable between an open and a closed position.

19. Dispenser according to claim 18, in which the rotary device (300) forms the said at least one dispensing orifice (30).

20. Dispenser according to claim 18, in which the rotary device (300) forms an outlet non-return valve seat (303).

21. Dispenser according to claim 18, in which the rotary device (300) forms a visible external part of the dispensing head.

22. Fluid product dispenser comprising:

a gas reservoir, a fluid product reservoir, a dispensing head comprising at least one dispensing orifice, the gas reservoir and fluid product reservoir being connected to the head so that their contents can communicate with the said at least one dispensing orifice; and a movable actuation wall to simultaneously generate a pressure state in the gas and fluid product reservoirs and thus force the fluid product and the gas through the said at least one dispensing orifice;

wherein the dispensing head comprises a gas outlet non-return valve located between the gas reservoir and at least one dispensing orifice, the dispensing head comprising a fluid product non-return valve located between the fluid product reservoir and at least one of the said at least one dispensing orifice, the gas outlet non-return valve comprising a gas non-return valve mobile member and a gas non-return valve seat, the fluid product non-return valve comprising a fluid product non-return valve mobile member and a fluid product non-return valve seat, the mobile members being formed by a monobloc part; and wherein the monobloc part (330) forms two concentric sleeves (332, 334) comprising ends connected together and opposite ends forming two deformable flexible lips (111, 33) defining the mobile members.

23. A fluid product dispenser comprising:

a gas reservoir containing a gas;

a fluid reservoir containing a fluid;

a dispensing head comprising an outlet, the gas reservoir and fluid product reservoir connected to the head so that their contents can communicate with the outlet; and a movable actuation wall that, when actuated, simultaneously generates a pressure state in the gas and fluid product reservoirs and forces the fluid and the gas through the outlet;

wherein the dispensing head further comprises a gas outlet non-return valve located between the gas reservoir and the outlet and a fluid outlet non-return valve located between the fluid reservoir and the outlet, and wherein the gas outlet non-return valve opens and closes at a pressure Pg that is below a pressure Pf at which the fluid product non-return valve (33) opens and closes.

* * * * *